US009593874B2

(12) United States Patent
Brown et al.

(10) Patent No.: US 9,593,874 B2
(45) Date of Patent: Mar. 14, 2017

(54) ICE MOLD FOR BOTTLENECK

(71) Applicant: Electrolux Home Products, Inc., Charlotte, NC (US)

(72) Inventors: Andrew D. Brown, Anderson, SC (US); Nilton Carlos Bertolini, Rayong (TH)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 641 days.

(21) Appl. No.: 13/768,083

(22) Filed: Feb. 15, 2013

(65) Prior Publication Data

US 2014/0230474 A1 Aug. 21, 2014

(51) Int. Cl.
*F25C 5/00* (2006.01)
*F25C 1/22* (2006.01)

(52) U.S. Cl.
CPC ..... *F25C 5/005* (2013.01); *F25C 1/22* (2013.01); *F25C 2305/022* (2013.01)

(58) Field of Classification Search
CPC .. F25C 5/005; F25C 5/007; F25C 1/22; F25C 2600/02; F25C 2600/04; B29C 33/0022; B29C 39/24; B29C 39/44; B22D 37/00; B22D 39/00; B22D 35/04; B22D 41/14; B22D 41/16; B22D 41/22
USPC ..... 62/177, 233; 425/159; 164/133, 155.1, 164/475
See application file for complete search history.

(56) References Cited

U.S. PATENT DOCUMENTS

| | | | | |
|---|---|---|---|---|
| 1,894,897 | A | 1/1933 | Tinkham | |
| 1,907,503 | A | 5/1933 | Chilton | |
| 3,252,293 | A * | 5/1966 | Frei, Sr. | F25C 1/24 62/135 |
| 6,092,374 | A * | 7/2000 | Kang | F25C 1/04 62/233 |
| 6,345,802 | B2 | 2/2002 | Moore | |
| 6,467,532 | B1 * | 10/2002 | Andersen | B22D 18/04 164/155.1 |
| 6,637,721 | B1 | 10/2003 | Zonca | |
| 6,761,347 | B2 | 7/2004 | Moore | |
| 6,779,588 | B1 * | 8/2004 | Good | B22D 18/04 164/119 |
| 7,475,555 | B2 | 1/2009 | Janardhanam et al. | |
| 7,869,901 | B2 | 1/2011 | Johnson et al. | |
| 2001/0011460 | A1 * | 8/2001 | Tchougounov | F25C 1/04 62/71 |

(Continued)

FOREIGN PATENT DOCUMENTS

JP 2005351624 A * 12/2005

*Primary Examiner* — Allana Lewin Bidder
*Assistant Examiner* — Kun Kai Ma
(74) *Attorney, Agent, or Firm* — Pearne & Gordon LLP

(57) ABSTRACT

An ice making assembly includes an ice tray extending along a longitudinal axis. The ice tray includes a first section disposed at a longitudinal first end of the ice tray, the first section including a plurality of first cavities projecting into the ice tray. The ice tray further includes a second section disposed at a longitudinal second end of the ice tray that is opposite from the longitudinal first end. The second section includes an elongated second cavity extending in a direction that is substantially transverse to the longitudinal axis of the ice tray. The second cavity has a shape that is longer in length than a length of each of the first cavities.

15 Claims, 6 Drawing Sheets

(56) References Cited

U.S. PATENT DOCUMENTS

| | | | | |
|---|---|---|---|---|
| 2003/0000573 | A1* | 1/2003 | Yoshioka | A01G 27/003 137/78.3 |
| 2004/0262792 | A1* | 12/2004 | Huard | B29C 39/24 264/1.32 |
| 2005/0064069 | A1* | 3/2005 | Adams | 426/66 |
| 2006/0090485 | A1* | 5/2006 | Lee | F25C 1/04 62/135 |
| 2006/0097127 | A1 | 5/2006 | Firth | |
| 2006/0242971 | A1* | 11/2006 | Cole et al. | 62/66 |
| 2007/0089441 | A1* | 4/2007 | Ito et al. | 62/135 |
| 2008/0261046 | A1* | 10/2008 | Husler | B29C 70/44 428/411.1 |
| 2010/0018226 | A1* | 1/2010 | Kim | F25C 1/18 62/73 |
| 2013/0019806 | A1* | 1/2013 | De Groot | A01J 5/01 119/14.02 |

* cited by examiner

ICE MOLD FOR BOTTLENECK

BACKGROUND OF THE INVENTION

Field of the Invention

The present invention relates generally to ice making assemblies, and, more particularly, to ice making assemblies having ice trays with shaped ice cube cavities.

Description of Related Art

Traditional refrigerators have been known to include ice making assemblies. For example, it is known to provide an ice making assembly having an ice tray with shaped ice cube cavities. The ice tray is filled with a liquid, such as water, whereupon the liquid is frozen to produce ice cubes. However, conventional ice cube cavities produce ice cubes having a size and shape that matches the size and shape of the ice cube cavities. This size and shape is generally too large to fit through an opening in conventional bottles and cans (e.g., bottles of water, pop cans, etc.). Therefore, it would be beneficial to provide an ice tray that produces ice cubes sized and shaped to be inserted into conventional bottles and cans. It would further be beneficial to allow a user to select the size and shape of cubes to be made.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, an ice making assembly is provided for use in a refrigerator assembly. The ice making assembly includes an ice tray extending along a longitudinal axis. The ice tray includes a first section disposed at a longitudinal first end of the ice tray, the first section including a plurality of first cavities. The ice tray further includes a second section disposed at a longitudinal second end of the ice tray that is opposite from the longitudinal first end. The second section has an elongated second cavity extending in a direction that is substantially transverse to the longitudinal axis of the ice tray. The second cavity has a shape that is longer in length than a length of each of the first cavities.

In accordance with another aspect, an ice making assembly is provided for use in a refrigerator assembly. The ice making assembly includes an ice tray extending along a longitudinal axis. The ice tray includes a first section disposed at a longitudinal first end of the ice tray. The first section includes a plurality of first cavities, each of the plurality of first cavities having a substantially identical shape. The ice tray further includes a second section disposed at a longitudinal second end of the ice tray that is opposite from the longitudinal first end. The second section includes an elongated second cavity having a shape that is longer in length than the first cavities. The ice making assembly further includes a control system operably connected to the ice tray. The control system fills the ice tray with water for a first predetermined fill time such that the first cavities are filled with water and a second predetermined fill time after the first predetermined fill time such that the second cavity is filled with water.

In accordance with another aspect, an ice making assembly is provided for use in a refrigerator assembly. The ice making assembly includes an ice tray extending along a longitudinal axis. The ice tray includes a first section disposed at a longitudinal first end of the ice tray, the first section including a plurality of first cavities. The ice tray further includes a second section disposed at a longitudinal second end of the ice tray that is opposite from the longitudinal first end, the second section including an elongated second cavity extending in a direction that is substantially transverse to the longitudinal axis of the ice tray. The ice making assembly further includes a receptacle including a dividing wall separating the receptacle into a first portion and a second portion. The first portion is configured to receive first ice cubes formed by the first cavities and the second portion is configured to receive second ice cubes formed by the second cavity.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF THE INVENTION

Figure 1:
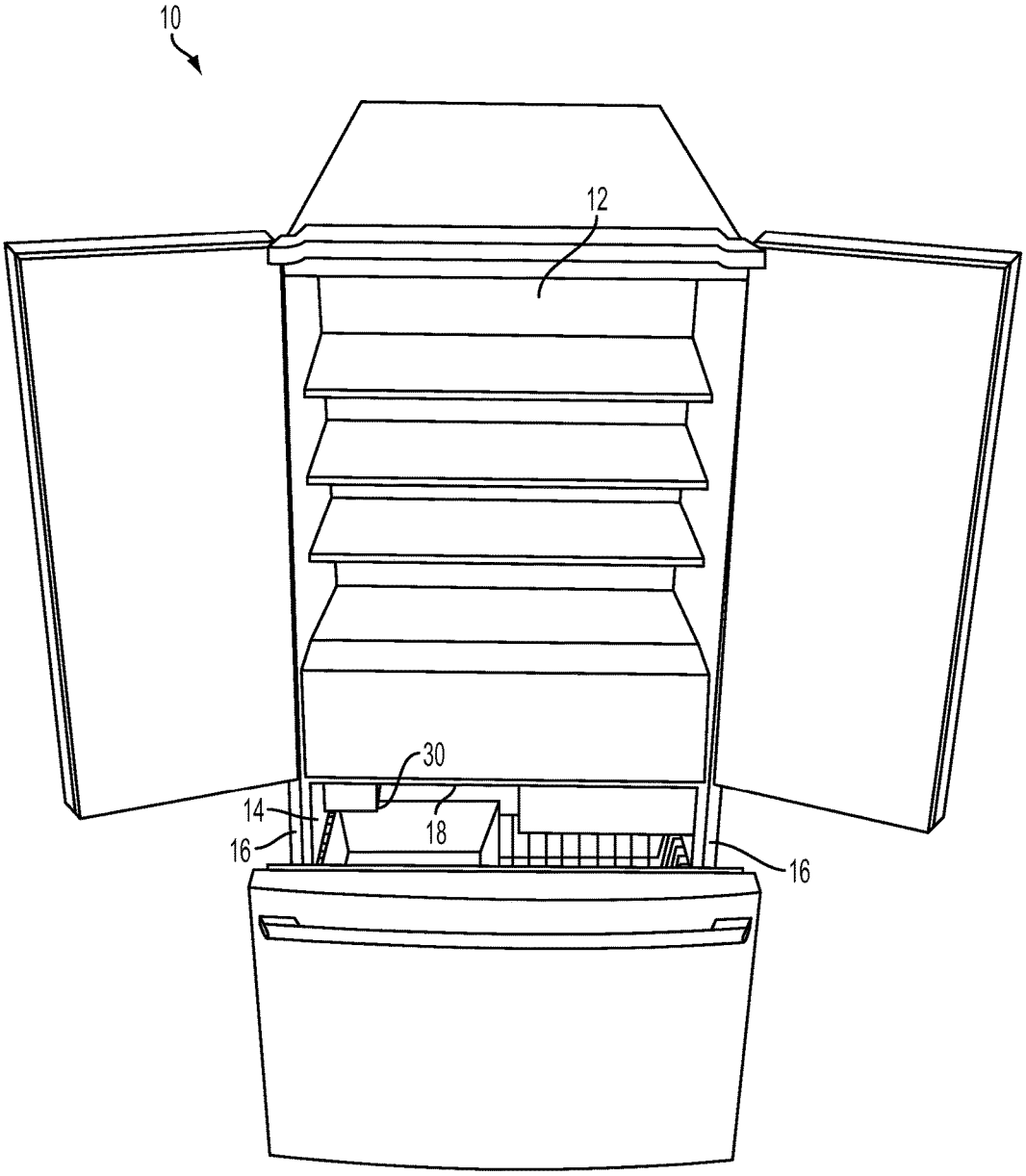
FIG. 1 is a perspective view of an example refrigerator assembly with an example ice making assembly positioned in a freezer compartment.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the example of FIG. 1, an example refrigerator assembly 10 is shown. In short summary, the refrigerator assembly 10 includes one or more compartments, such as a fresh food compartment 12 and a freezer compartment 14. An ice making assembly 30 is positioned in either or both of the fresh food compartment 12 and freezer compartment 14. As will be described in detail below, the ice making assembly 30 is used to form ice cubes of varying shapes and sizes. In one example, the ice making assembly 30 can form ice cubes having an elongated shape that are designed to fit within a conventionally sized bottle opening.

The refrigerator assembly 10 shown in FIG. 1 comprises one possible example of a refrigerator assembly 10. In this example, the refrigerator assembly includes a French door bottom mount freezer assembly. A French door bottom mount freezer assembly includes the fresh food compartment 12 provided at an upper portion of the refrigerator assembly 10 while the freezer compartment 14 is provided at a lower portion and underneath the fresh food compartment 12. In further examples, the refrigerator assembly 10 could be provided with multiple compartments or with compartments located above and/or laterally with respect to one another. The refrigerator assembly 10 could further include a side by side fresh food compartment and freezer compartment, such that the refrigerator assembly 10 is not limited to the shown French door bottom mount freezer. In particular, the refrigerator assembly 10 includes the fresh food compartment 12 positioned laterally next to the freezer compartment 14. In yet another example, the refrigerator assembly 10 may include only a freezer compartment provided without the fresh food compartment or a fresh food compartment without the freezer compartment. Accordingly, it is to be appreciated that the refrigerator assembly 10 shown in FIG. 1 comprises only one possible example, as any number of designs and configurations are contemplated.

The refrigerator assembly 10 includes the fresh food compartment 12. The temperature in the fresh food compartment 12 is maintained at a first temperature. The first temperature can be maintained at a wide range of temperatures, such as at or above 0° C. (32° F.). The fresh food compartment 12 defines a substantially hollow interior portion and may include shelves, drawers, or the like. Food items in the fresh food compartment 12 are maintained at the first temperature. The fresh food compartment 12 can include a pair of doors, such as French doors. It is to be appreciated, however, that the fresh food compartment 12 could include other door assemblies, and is not limited to having the French doors shown in FIG. 1. Rather, in further examples, the fresh food compartment 12 could include a single door, or the like. It is to be appreciated that the fresh food compartment 12 shown in FIG. 1 is somewhat generically depicted, as the fresh food compartment 12 can include any number of shelves, drawers, bins, etc.

The refrigerator assembly 10 further includes the freezer compartment 14. The freezer compartment 14 can be positioned adjacent and underneath the fresh food compartment 12. It is to be appreciated, however, that the freezer compartment 14 could be positioned laterally next to (e.g., side by side) or above (e.g., on top of) the fresh food compartment 12. The freezer compartment 14 can be maintained at a wide range of temperatures, such as at or below 0° C. (32° F.). In one particular example, the freezer compartment 14 is maintained at a temperature range of about −21° C. (−5° F.) to about −23° C. (−10° F.). As such, the freezer compartment 14 can be maintained at a second temperature that is lower than the first temperature of the fresh food compartment 12.

The freezer compartment 14 defines a substantially hollow interior portion and may include shelves, drawers, or the like. The freezer compartment 14 is bounded by side walls 16 and a dividing wall 18. The freezer compartment 14 can include three side walls positioned laterally around the freezer compartment 14, with a fourth side (i.e., front facing side) being opened to receive a freezer door. The dividing wall 18 includes a substantially horizontally oriented wall defining an upper portion of the freezer compartment 14 that separates the freezer compartment 14 from the fresh food compartment 12. The dividing wall 18 can be positioned between the freezer compartment 14 and the fresh food compartment 12. In one example, the dividing wall 18 can include an upper wall defining an upper surface of the freezer compartment 14.

The freezer compartment 14 can further include the ice making assembly 30. The ice making assembly 30 is somewhat generically depicted in FIG. 1 for illustrative purposes. In the shown example, the ice making assembly 30 is positioned at an upper corner of the freezer compartment 14 adjacent the dividing wall 18. In further examples, however, the ice making assembly 30 could be positioned at other locations, such as at a variety of locations in the freezer compartment 14 or in the fresh food compartment 12. Indeed, the ice making assembly 30 could be positioned along nearly any of the walls of the freezer compartment 14 or fresh food compartment 12, within the doors, etc. In the example of FIG. 1, the ice making assembly 30 includes a cover, door, or similar structures that selectively restrict access to an interior of the ice making assembly 30. Of course, it is to be understood that in further examples, the ice making assembly 30 need not include the shown cover.

Figure 2:
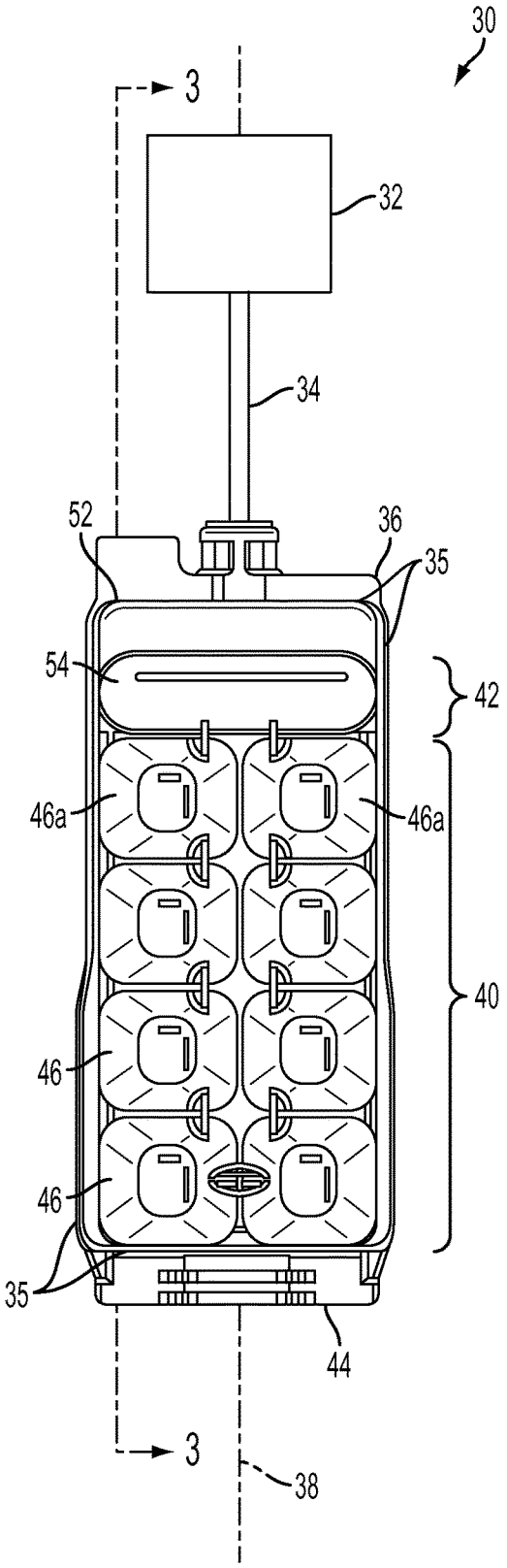
FIG. 2 is a plan view of an ice tray of the ice making assembly.

Referring now to FIG. 2, the ice making assembly 30 is more clearly shown. In this example, the ice making assembly 30 is depicted without the cover for ease of illustration and to more clearly depict portions of the ice making assembly 30. The ice making assembly 30 can include a drive unit 32. The drive unit 32 is generically/schematically depicted as it is to be understood that the drive unit 32 includes a number of different structures. In one example, the drive unit 32 includes a motor, or the like, that provides a rotational output. The drive unit 32 can include a drive shaft 34 attached to the drive unit 32. In one example, the drive shaft 34 is movably attached (e.g., rotatably attached) to the drive unit 32. As such, rotational output from the drive unit 32 can cause likewise rotation of the drive shaft 34. It is to be understood, however, that the drive unit 32 and drive shaft 34 comprise only one of many possible means for driving a rotational output.

The ice making assembly 30 further includes an ice tray 36. The ice tray 36 can be attached to the drive shaft 34. In one example, the ice tray 36 can be fixedly attached to the drive shaft 34 such that rotation of the drive shaft 34 by the drive unit 32 can cause the ice tray 36 to rotate as well. In other examples, however, the ice tray 36 can be indirectly attached to the drive shaft 34, such as by attaching the drive shaft 34 to a cover while the cover is attached to the ice tray 36.

The ice tray 36 defines a generally rectangularly shaped structure extending along a longitudinal axis 38. It is to be appreciated, however, that other shapes and sizes are envisioned. For example, the ice tray 36 could have a longer or shorter length and/or width than as shown. Even further, the ice tray 36 is not limited to the rectangular shape shown in FIG. 2, and, instead, could include square shapes, oval shapes, circular shapes, or the like. As such, the ice tray 36 shown in FIG. 2 comprises merely one possible example of an ice tray, as a number of different examples are envisioned. The ice tray 36 can include sidewalls 35 defining an outer boundary of the ice tray 36. In the shown example, the ice tray 36 includes four sidewalls, with two sidewalls extending along the longitudinal axis 38 and the other two sidewalls extending in a direction transverse to the longitudinal axis 38.

The ice tray 36 can include a first section 40 and a second section 42. The first section 40 is disposed at a longitudinal first end 44 of the ice tray 36 and extends along at least a portion of the length of the ice tray 36. In the shown example, the first section 40 extends along a majority of the length of the ice tray 36, but in further examples, could extend a longer or shorter distance than as shown.

The first section 40 includes one or more first cavities 46 that project into the ice tray 36. The first cavities 46 each define a substantially hollow recess that can receive a liquid (e.g., water or the like). The first cavities 46 are shown to be positioned in a side by side orientation (i.e., two columns formed) with a total of four rows of first cavities 46. As is generally known, the first cavities 46 can be separated from each other with separating walls or the like. In further examples, the first cavities 46 could include greater than or fewer than the number of cavities shown in FIG. 2. Similarly, the first cavities 46 are not limited to the shown side by side orientation, and in further examples, could form a single column, or more than two columns. The first cavities 46 are generally square-shaped with rounded corners. In further examples, the first cavities 46 are not limited to the square shape shown in FIG. 2, and could include any number of shapes. These shapes include, but are not limited to, circular shapes, rectangular shapes, oval shapes, etc. While the first cavities 46 are each shown to have a substantially identical shape, in further examples, the first cavities 46 can have each have different shapes. Accordingly, the arrangement of the first cavities 46 shown in FIG. 2 comprises only one possible example, as a number of different sizes, shapes, and configurations are envisioned.

The ice tray 36 further includes the second section 42. The second section 42 is disposed at a longitudinal second end 52 of the ice tray 36 opposite from the first end 44. The second section 42 extends along at least a portion of the length of the ice tray 36. In the shown example, the second section 42 extends along a smaller length of the ice tray 36 than the first section 40. However, in further examples, the second section 42 can extend a longer or shorter distance than as shown.

The second section 42 includes at least one second cavity 54 that projects into the ice tray 36. The second cavity 54 defines an elongated, substantially hollow recess that can receive a liquid (e.g., water or the like). The second cavity 54 extends in a direction that is substantially transverse to the longitudinal axis 38 of the ice tray 36. The second cavity 54 is longer in length than a length of the first cavities 46. Further, the second cavity 54 can have a smaller width than the length of any of the first cavities 46, such that the second cavity 54 is narrower, thinner, etc. than the first cavities 46. As such, the second cavity 54 produces ice cubes that are longer and thinner than ice cubes produced by the first cavities 46.

The second section 42 is shown to include only the single second cavity 54. However, in further examples, the second cavity 54 is not limited to the shown orientation. Rather, the second section 42 can include a plurality of second cavities 54. In such an example, the second cavities 54 can extend generally parallel to each other in a direction that is substantially transverse to the longitudinal axis 38. In other examples, the second cavity 54 could extend substantially parallel to the longitudinal axis 38, such that the second cavity 54 extends lengthwise with respect to the ice tray 36. As will be described in more detail below, the second cavity 54 is not limited to the elongated, linear shape, as other embodiments are envisioned.

Figure 3:
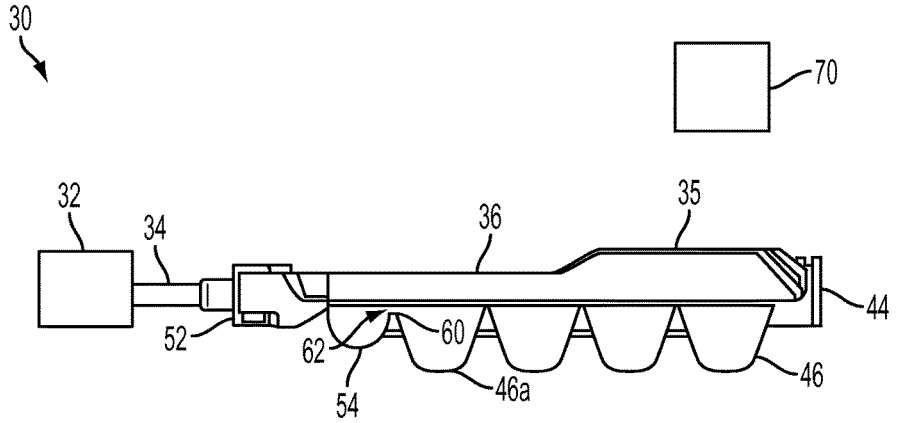
FIG. 3 is a sectional view of the ice tray of the ice making assembly in an unfilled state.

Turning now to FIG. 3, a sectional view of the ice making assembly 30 is shown taken from lines 3-3 of FIG. 2. The ice making assembly 30 can further include a separating wall 60. The separating wall 60 separates the first section 40 from the second section 42. In particular, the separating wall 60 separates an adjacent first cavity **46*a* from the second cavity 54. The separating wall 60 extends in a direction that is substantially transverse to the longitudinal axis 38 of the ice tray 36. In the shown example, the separating wall 60 can extend generally parallel to the direction along which the second cavity 54 extends. The separating wall 60 need not be limited to a separate structure from the adjacent first cavity 46*a* and second cavity 54. Rather, the separating wall 60 could be formed integrally or as a part of either or both of the adjacent first cavity 46*a* and second cavity 54. For example, as shown in FIG. 3, the separating wall 60 is defined by the intersection of a wall of the adjacent first cavity 46*a* and an adjacent wall of the second cavity 54. However, in other examples, the separating wall 60 could include a separate structure that is not formed as a part of the adjacent first cavity 46*a* and/or the second cavity 54**.

The separating wall 60 has a height that is less than a height of walls forming the first cavities 46. In particular, an upper portion of the separating wall 60 can be lower than an upper portion of remaining walls of the adjacent first cavity **46*a*. Along these lines, a height of the separating wall 60 is less than a height of the walls forming the first cavities. For example, as shown in FIG. 3, the height of the separating wall 60 is lower than the height of the walls forming the first cavity 46 that is adjacent the first end 44. As such, the separating wall 60 defines an opening 62 positioned above the separating wall 60. In other examples, the separating wall 60 could extend a longer distance (e.g., higher) or a shorter distance (e.g., lower) than as shown in FIG. 3. As such, the opening 62 could likewise be larger or smaller than as shown. As will be described in more detail below, the separating wall 60 and opening 62 allow for liquid to overflow from the adjacent first cavity 46*a* and into the second cavity 54**.

The ice making assembly 30 further includes a filling apparatus 70. The filling apparatus 70 provides liquid, such as water, to the ice tray 36. The filling apparatus 70 is somewhat generically/schematically depicted in FIG. 3 as it is to be understood that the filling apparatus 70 comprises a number of different structures. For example, the filling apparatus 70 can include hoses, pumps, valves, etc. that can deliver liquid to the first cavities 46 and second cavity 54 of the ice tray 36. Further, while the filling apparatus 70 is shown to be positioned above the first section 40 and adjacent the first end 44, such a location is not intended to be limiting. Rather, the filling apparatus 70 could instead be connected to the first section 40 by means of a hose, tube, or the like. In such an example, the filling apparatus 70 could be attached to the first end 44 of the first section 40 such that liquid flows into the first cavities 46.

Figure 4:
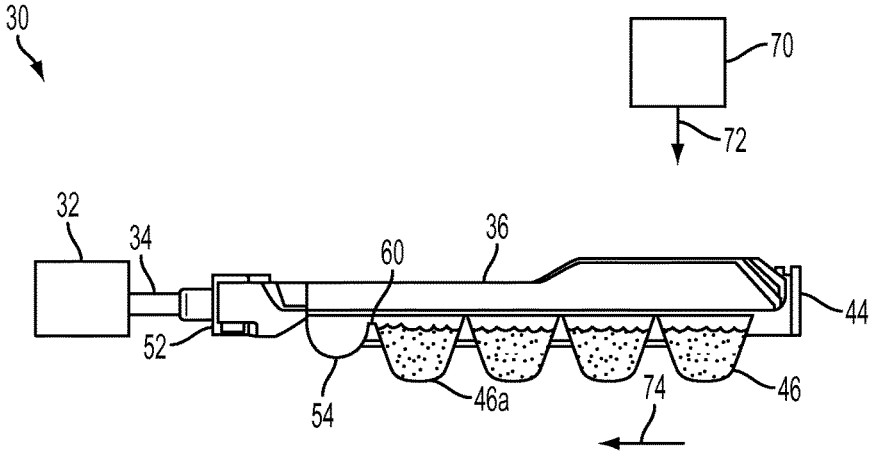
FIG. 4 is a sectional view of the ice tray of the ice making assembly similar to FIG. 3 with the ice tray in a partially filled state.

Turning now to FIG. 4, a method of forming ice cubes with the ice making assembly 30 for use in the freezer compartment 14 can now be described. Initially, the ice tray 36 is empty and contains no liquid (as shown in FIG. 3). To form the ice cubes, the filling apparatus 70 is initiated to begin filling the ice tray 36 with liquid. The filling apparatus 70 can deliver liquid to the ice tray 36 along a flow path 72. The flow path 72 is depicted generically (with an arrow) in FIG. 4 for illustrative purposes. However, in operation, the flow path 72 defines liquid flowing from an exterior of the ice making assembly 30 (i.e., from the filling apparatus 70), into the ice making assembly 30, and into the ice tray 36. The filling apparatus 70 can continue to fill the ice tray 36 with liquid for a predetermined time. This predetermined time can be sufficient to allow for the first section 40 to fill with liquid.

The filling apparatus 70 is positioned above the first section 40 in close proximity to the first end 44. As such, the filling apparatus 70 can initially fill the first cavities 46 that are adjacent the first end 44. As the first cavities 46 adjacent the first end 44 become full, liquid can overflow from the first cavities 46 and flow into neighboring first cavities along a flow direction 74. This overflow of liquid can continue until the liquid fills the adjacent first cavity 46*a*.

As shown in FIG. 4, the filling apparatus 70 can initially fill the ice tray 36 until each of the first cavities 46 has been filled with liquid. In one example, the filling apparatus 70 can be controlled by a timer, such that the filling apparatus 70 can deliver liquid to the ice tray 36 for a first predetermined fill time. This first predetermined fill time can be in a range of about five to six seconds, though other times are envisioned. After this first predetermined fill time expires, the filling apparatus 70 will stop delivering the liquid to the ice tray 36. At this point, the first cavities of the first section 40 can each be substantially filled with the liquid while the second cavity 54 remains generally empty. As such, the first predetermined fill time can correspond to the amount of time it takes for the filling apparatus 70 to fill the first cavities 46. In further examples, however, the first predetermined fill time could be shorter, due to a higher flow rate of liquid from the filling apparatus 70. In other examples, the first predetermined fill time could be longer, such as due to a lower flow rate of liquid from the filling apparatus 70.

Figure 5:
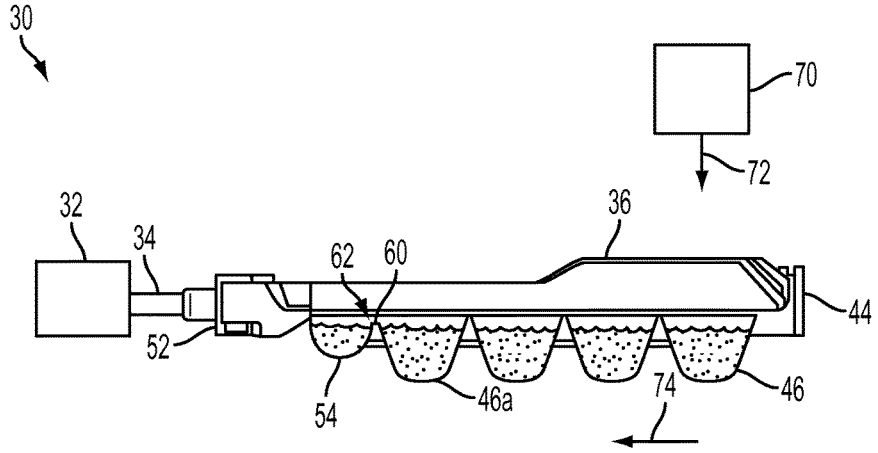
FIG. 5 is a sectional view of the ice tray of the ice making assembly similar to FIG. 3 with the ice tray in a filled state.

Turning now to FIG. 5, the ice tray 36 can be further filled with liquid such that the liquid fills the second cavity 54 as well as the first cavities 46. After the first predetermined fill time has expired, liquid flow from the filling apparatus 70 stops. However, to fill the second cavity 54 with liquid, the filling apparatus 70 can be turned on for a second predetermined fill time after the first predetermined fill time. During this second predetermined fill time, liquid is delivered from the filling apparatus 70, along the flow path 72, and into the ice tray 36. Since the first section 40 of the ice tray, including the first cavities 46, is already substantially full, liquid delivered during this second predetermined fill time will cause liquid to overflow into the second cavity 54. In particular, liquid in the adjacent cavity first 46*a* will flow over the separating wall 60 and through the opening 62, thus causing the second cavity 54 to fill as well. The second predetermined fill time can correspond to the amount of time it takes for the filling apparatus 70 to fill the second cavity 54. In one example, the second predetermined fill time can last about one to two seconds, though other times are envisioned.

After the second predetermined fill time is stopped, the first cavities 46 and second cavity 54 are substantially filled with liquid. Since the ice making assembly 30 is located in an area of sub-freezing temperature, the liquid in the ice tray 36 can freeze. As such, ice cubes having a shape matching both the first cavities 46 and second cavity 54 can be formed.

Figure 6:
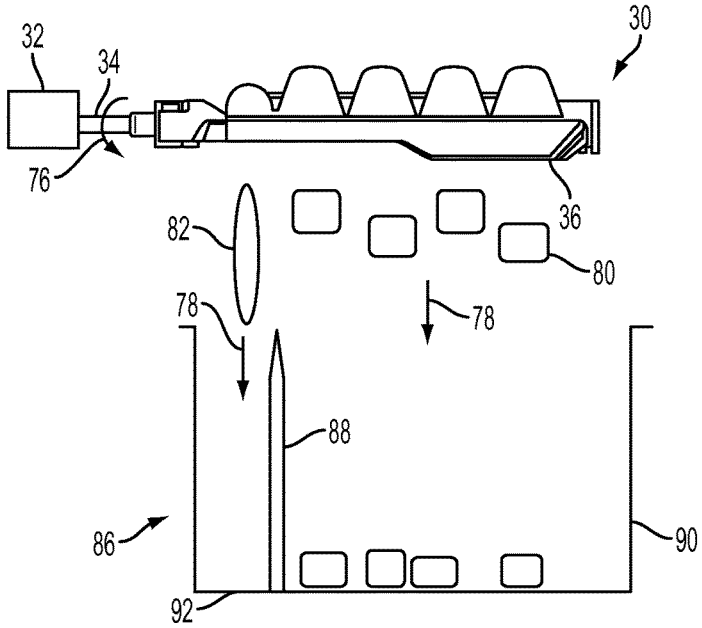
FIG. 6 is a side elevation view of the ice tray depositing ice cubes into a receptacle.

Turning now to FIG. 6, after the liquid in the first cavities 46 and second cavity 54 has frozen to form ice cubes, the ice cubes can be removed from the ice tray 36. To remove the ice cubes, the ice tray 36 is rotated. In particular, the drive unit 32 causes the drive shaft 34 to rotate in a rotational direction 76. This rotation likewise causes the ice tray 36 to rotate, thus inverting the ice tray 36. In this inverted position, the ice cubes in the ice tray 36 can become dislodged from the ice tray 36 and fall in a first direction 78 away from the ice tray 36. In further examples, heat can be provided to assist in dislodging the ice cubes from the ice tray 36. The ice cubes are somewhat generically/schematically depicted, as it is understood that the ice cubes may not have a uniform shape. In the shown example, however, first ice cubes 80 that fall from the first cavities 46 can have a generally cuboid shape. Similarly, a second ice cube 82 that falls from the second cavity 54 can have a generally elongated ovoid shape.

The first and second ice cubes 80, 82 can be collected in a receptacle 86. The receptacle can be positioned underneath the ice making assembly 30 such that the ice cubes 80, 82 can fall under the influence of gravity into the receptacle 86. The receptacle 86 is generically/schematically depicted as it is to be appreciated that the receptacle 86 can include a number of different structures for collecting and/or holding the ice cubes. The receptacle 86 can include buckets, bins, baskets, drawers, etc.

The receptacle 86 includes a dividing wall 88 that separates the receptacle 86 into a first portion 90 and a second portion 92. The first portion 90 is positioned to receive the first ice cubes 80 while the second portion 92 is positioned to receive the second ice cubes 82. In particular, the first portion 90 is aligned with the first section 40 by being positioned below the first section 40. Likewise, the second portion 92 is aligned with the second section 42 by being positioned below the second section 42. As such, the receptacle 86 can function to receive and segregate the ice cubes into the first portion 90 and second portion 92.

Figure 7:
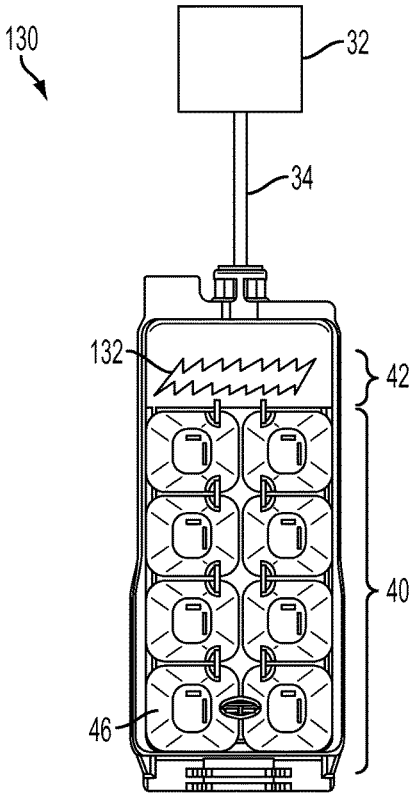
FIG. 7 is a plan view of a second example ice tray of a second example ice making assembly.

Turning now to FIG. 7, a second example of an ice making assembly 130 is shown. The second ice making assembly 130 includes the first section 40 and second section 42. The first section 40 is substantially identical to the first section 40 described above with respect to the ice making assembly 30, and need not be described again. Similarly, the second ice making assembly 130 also includes the drive unit 32 and drive shaft 34 that are each identical to the drive unit 32 and drive shaft 34 described with respect to the ice making assembly 30.

The second section 42 of the second ice making assembly 130 can include a second cavity comprising a bolt shaped cavity 132. The bolt shaped cavity 132 is an elongated, substantially hollow recess that receives liquid. The bolt shaped cavity 132 extends in a direction that is substantially transverse to the longitudinal axis 38 of the ice tray 36. As with the second cavity 54 described above, the bolt shaped cavity 132 is longer in length than a length of the first cavities 46. Further, the bolt shaped cavity 132 has a smaller width than the length of any of the first cavities 46, such that the bolt shaped cavity 132 is narrower, thinner, etc. than the first cavities 46. As such, the bolt shaped cavity 132 produces ice cubes that are longer and thinner than ice cubes produced by the first cavities 46. In particular, the bolt shaped cavity 132 can produce ice cubes that have the bolt shape.

The bolt shaped cavity 132 has a lightning bolt shape with a plurality of zigzagged portions. In particular, the edges of the bolt shaped cavity 132 do not extending linearly but, rather, have a non-linear zigzag shape. The edges of the bolt shaped cavity 132 project inwardly (i.e., towards a center of the bolt shaped cavity 132) and outwardly (away from a center of the bolt shaped cavity 132). As such, the bolt shaped cavity 132 includes edges that define a non-linear shape.

Figure 8:
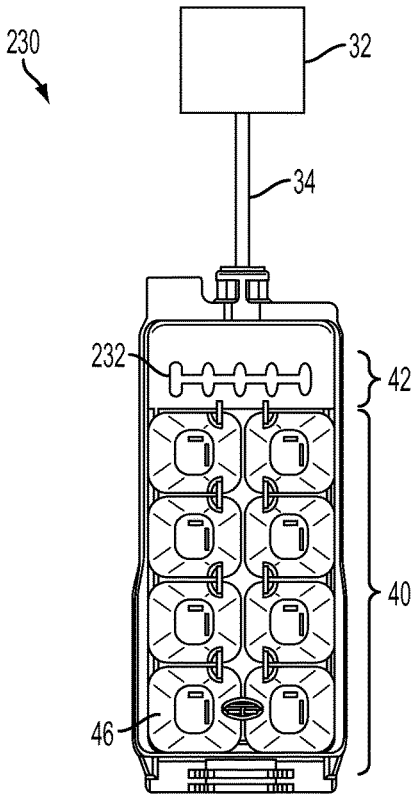
FIG. 8 is a plan view of a third example ice tray of a third example ice making assembly.

Turning now to FIG. 8, a third example of an ice making assembly 230 is shown. The third ice making assembly 230 includes the first section 40 and second section 42. The first section 40 is substantially identical to the first section 40 described above with respect to the ice making assembly 30, and need not be described again. Similarly, the third ice making assembly 230 also includes the drive unit 32 and drive shaft 34 that are each identical to the drive unit 32 and drive shaft 34 described with respect to the ice making assembly 30.

The second section 42 of the third ice making assembly 230 can include a second cavity comprising a rib shaped cavity 232. The rib shaped cavity 232 is an elongated, substantially hollow recess that receives liquid. The rib shaped cavity 232 extends in a direction that is substantially transverse to the longitudinal axis 38 of the ice tray 36. As with the second cavity 54 described above, the rib shaped cavity 232 is longer in length than a length of the first cavities 46. Further, the rib shaped cavity 232 has a smaller width than the length of any of the first cavities 46, such that the rib shaped cavity 232 is narrower, thinner, etc. than the first cavities 46. As such, the rib shaped cavity 232 produces ice cubes that are longer and thinner than ice cubes produced by the first cavities 46. In particular, the rib shaped cavity 232 can produce second ice cubes having a rib shape.

The rib shaped cavity 232 has a ribbed shape with a plurality of undulating edges. In particular, the edges of the rib shaped cavity 232 do not extending linearly but, rather, have a non-linear undulating ribbed shape. The edges of the rib shaped cavity 232 project inwardly (i.e., towards a center of the rib shaped cavity 232) and outwardly (away from a center of the bolt shaped cavity 132). The inward and outward projections are each separated by linearly extending portions. As such, the rib shaped cavity 232 includes edges that define a non-linear shape. By providing rib shaped ice cubes, the linear portions of the walls can melt faster than the ribbed portion. As such, the rib shaped ice cube can partially melt when exposed to a relatively warmer liquid and allow for the rib shaped ice cube to break up into a plurality of smaller ice cubes. These smaller ice cubes can have a greater cooling capacity than the larger rib shaped ice cube.

Figure 9:
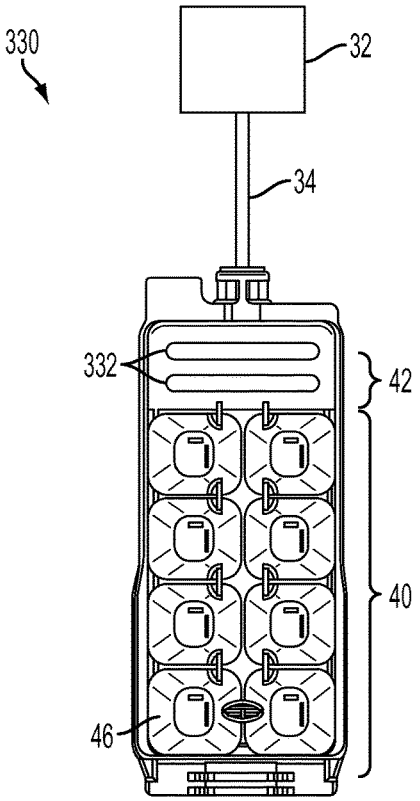
FIG. 9 is a plan view of a fourth example ice tray of a fourth example ice making assembly.

Turning now to FIG. 9, a fourth example of an ice making assembly 330 is shown. The fourth ice making assembly 330 includes the first section 40 and second section 42. The first section 40 is substantially identical to the first section 40 described above with respect to the ice making assembly 30, and need not be described again. Similarly, the fourth ice making assembly 330 also includes the drive unit 32 and drive shaft 34 that are each identical to the drive unit 32 and drive shaft 34 described with respect to the ice making assembly 30.

The second section 42 of the fourth ice making assembly 330 can include a second cavity comprising elongated cavities 332. In particular, the elongated cavities 332 comprise a pair of elongated cavities that extend generally parallel to each other. The elongated cavities 332 each include a linear, elongated, substantially hollow recess that receives the liquid. The elongated cavities 332 extend in a direction that is substantially transverse to the longitudinal axis 38 of the ice tray 36. The elongated cavities 332 can have a similar shape as the second cavity 54 described above. For example, the elongated cavities 332 can each have a longer length than a length of the first cavities 46 and may have a smaller width than the length of any of the first cavities 46. The elongated cavities 332 can therefore produce ice cubes that are longer and thinner than ice cubes produced by the first cavities 46.

The second section 42 is shown to include two elongated cavities arranged in a side by side orientation. However, in further examples, the second section 42 could include more than the two elongated cavities 332 (or a single elongated cavity). Further, the elongated cavities 332 may have different dimensions than as shown, such as by being longer or shorter in length, or being wider or narrower in width. Further still, the elongated cavities 332 need not be identical in shape, and could include any combination of shapes and sizes, such as by including one or more shapes from the other designs shown in FIGS. 2 and 7-10. As such, the elongated cavities 332 shown in FIG. 9 comprise only one possible example of the elongated cavities 332.

Figure 10:
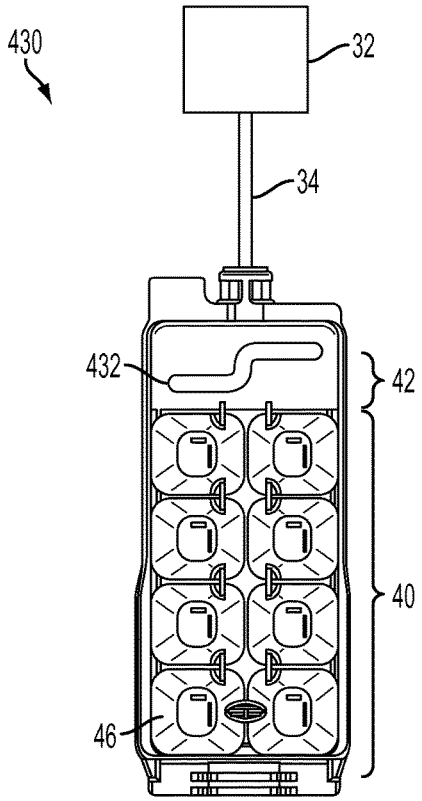
FIG. 10 is a plan view of a fifth example ice tray of a fifth example ice making assembly.

Turning now to FIG. 10, a fifth example of an ice making assembly 430 is shown. The fifth ice making assembly 430 includes the first section 40 and second section 42. The first section 40 is substantially identical to the first section 40 described above with respect to the ice making assembly 30, and need not be described again. Similarly, the fifth ice making assembly 430 also includes the drive unit 32 and drive shaft 34 that are each identical to the drive unit 32 and drive shaft 34 described with respect to the ice making assembly 30.

The second section 42 of the fifth ice making assembly 430 can include a second cavity comprising a non-linear cavity 432. In particular, the non-linear cavity 432 includes a non-linear (e.g., not straight), elongated, substantially hollow recess that receives the liquid. The non-linear cavity 432 extends in a direction that is substantially transverse to the longitudinal axis 38 of the ice tray 36. The non-linear cavity 432 is shown to include a bend located substantially at a midpoint of the non-linear cavity 432. In further examples, the non-linear cavity 432 could also include a plurality of bends and/or bends that are off-centered (i.e., closer to ends of the non-linear cavity 432). Further, the non-linear cavity 432 is not limited to the shown bend with rounded edges, but instead could include bends with sharper edges (e.g., V-shaped bend, W-shaped bend, etc.) or the like. The non-linear cavity 432 can have a longer length than a length of the first cavities 46 and may have a smaller width than the length of any of the first cavities 46. In other examples, the non-linear cavity 432 could be longer or shorter than as shown and/or wider or narrower. The non-linear cavity 432 therefore produces ice cubes that are longer and thinner than the ice cubes produced by the first cavities 46.

Figure 11:
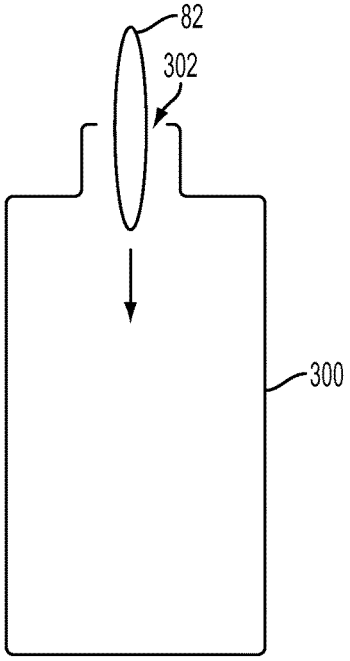
FIG. 11 is a side elevation view of an example ice cube from the ice tray being deposited into a container.

Turning now to FIG. 11, a container 300 is shown. The container 300 can include any number of objects for storing a liquid. For example, the container 300 can include water bottles, pop cans, etc. The container 300 includes an opening 302. Due to the relatively small size of the opening 302, the first ice cubes 80 may be too large to pass through. However, by providing the second ice cubes 82 formed by any of the second cavity 54 (FIG. 2), the bolt shaped cavity 132 (shown in FIG. 7), the rib shaped cavity (shown in FIG. 8), the elongated cavities 332 (shown in FIG. 9), or the non-linear cavity 432 (shown in FIG. 10), the dimensions of the second ice cubes 82 allow for the second ice cubes 82 to be inserted through the opening 302 of the container 300. It is to be appreciated that while FIG. 11 only depicts the second ice cube 82 produced by the second cavity 54, the ice cubes formed in the bolt shaped cavity 132, rib shaped cavity 232, elongated cavities 332, and/or the non-linear cavity 432 can function in an identical manner.

The opening 302 in the container 300 can vary based on the type of container 300. For example, the container 300 includes standard, commercially available pop cans. In such an example, the standard pop cans have opening dimensions of approximately 1" (25.4 mm) in maximum width and ¾" (19.05 mm) in maximum length. In another example, the container 300 includes standard, commercially available water bottles. In this example, such water bottles have an opening dimension of approximately 1¼" (31.75 mm) in diameter. Accordingly, the ice cubes formed in the bolt shaped cavity 132, rib shaped cavity 232, elongated cavities 332, and/or the non-linear cavity 432 are sized to pass through openings 302 in these standard pop cans and/or water bottles having the aforementioned dimensions.

Figure 12:
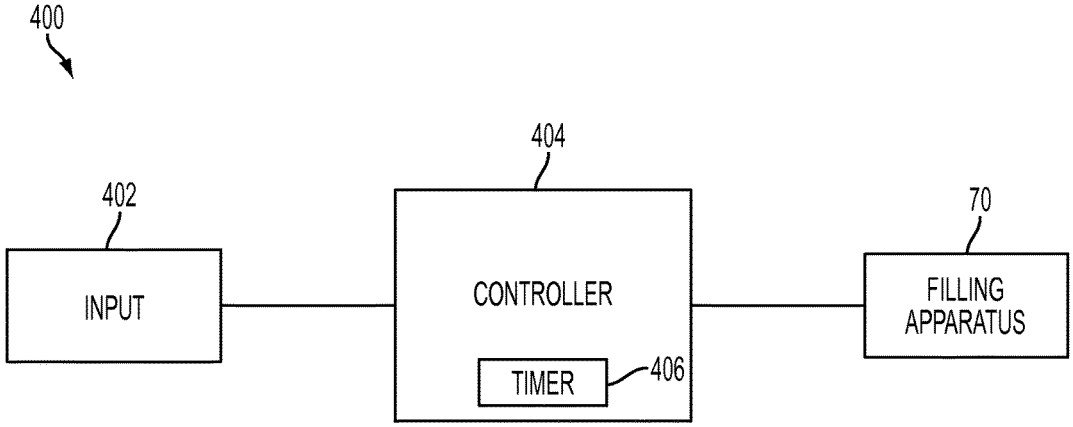
FIG. 12 is a schematic view of an example control system for controlling the ice making assembly.

Turning now to FIG. 12, the control of the method of forming the ice cubes with the ice making assembly 30, 130, 230, 330, 430 can now be described. A block diagram is shown of a control system 400. As shown, one example of the control system 400 includes an input 402. The input 402 can include a user interface, or the like, that allows a user to operate and/or adjust features of the ice making assembly 30, 130, 230, 330, 430. For example, the user could input the fill time of the filling apparatus 70 to the input 402. In such an example, the filling apparatus 70 could fill some or all of the ice tray 36 with liquid. In particular, the filling apparatus 70 could be set to fill only a portion of the first cavities 46, all of the first cavities 46, or both the first cavities 46 and the second cavity 54. As such, the user can input whether the ice making assembly 30, 130, 230 should produce only first ice cubes 80, or both first ice cubes 80 and second ice cubes 82.

To accomplish this feature, the control system 400 can include a controller 404. The controller 404 can be operatively connected to the input 402. As such, the input 402 can send a signal to the controller 404 that is indicative of the user's selection (e.g., only first ice cubes 80 or both first ice cubes 80 and second ice cubes 82). The controller 404 can further include a timer 406 in operative association with the controller 404. The timer 406 can be preset with the first and second predetermined fill times for the filling apparatus 70. As such, if the user selects that only first ice cubes 80 should be produced, then the controller 404 can determine the first predetermined fill time from the timer 406 that is needed to fill only the first cavities 46. Likewise, if the user selects that both the first ice cubes 80 and second ice cube 82 should be produced, then the controller 404 can determine the second predetermined fill time from the timer 408 that is needed to fill both the first cavities 46 and second cavities 54.

The controller 404 is operatively connected to the filling apparatus 70. The controller 404 can send signals indicative of the user's selection to control the filling apparatus 70. In operation, the controller 404 receives the user's input from the input 402. The controller 404 can then send a signal to the filling apparatus 70 to begin filling the ice tray 36 with liquid. Based on the user's selection, the timer 406 can control how long the filling apparatus 70 delivers liquid to the ice tray 36. For example, if the user selected for only the first cavities 46 to be filled, then the timer 406 allows the filling apparatus 70 to fill the ice tray 36 for the first predetermined period of time. However, if the user selected for the first cavities 46 and second cavity 54 to be filled, then the timer 406 allows the filling apparatus 70 to fill the ice tray 36 for the first and second predetermined period of time.

It is to be appreciated that the control system 400 shown in FIG. 12 includes only one possible configuration for controlling the filling of the ice tray 36. In further examples, the control system 400 can include other structures that assist in accurately filling the ice tray 36. These structures can include level sensors/detectors, valves, etc. Similarly, controller 404 could also be operatively connected to the drive unit 32 to control the dumping of the ice cubes. As such, the control system 400 depicts only one possible example of controlling the ice making assembly 30, 130, 230, 330, 430.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An ice making assembly for use in a refrigerator assembly, the ice making assembly including:

an ice tray extending along a longitudinal axis, the ice tray including:

a first section disposed at a longitudinal first end of the ice tray, the first section including a plurality of first cavities; and a second section disposed at a longitudinal second end of the ice tray that is opposite from the longitudinal first end, the second section including an elongated second cavity extending in a direction that is substantially transverse to the longitudinal axis of the ice tray, the second cavity having a shape that is different than a shape of each of the first cavities;

a control system operably connected to the ice tray, the control system being configured to deliver liquid to the ice tray for a first predetermined fill time and a second predetermined fill time after the first predetermined fill time, wherein the control system selectably delivers liquid to the first section of the ice tray during the first predetermined fill time to put liquid in only the plurality of first cavities, and to the first section and second section of the ice tray during a combination of the first predetermined fill time and the second predetermined fill time to put liquid in both the plurality of the first cavities and the second cavity.

2. The ice making assembly of claim 1, wherein the second cavity includes a rib shaped cavity.

3. The ice making assembly of claim 1, wherein the second cavity includes a bolt shaped cavity.

4. The ice making assembly of claim 1, wherein the second cavity includes a non-linear shape.

5. The ice making assembly of claim 4, wherein a depth of the second cavity is less than a depth of each of the first cavities.

6. The ice making assembly of claim 1, wherein the ice tray includes a separating wall positioned between the first section and the second section, the separating wall extending in a direction that is substantially transverse to the longitudinal axis of the ice tray.

7. The ice making assembly of claim 6, wherein a height of the separating wall is less than a height of walls forming the first cavities such that the separating wall defines an opening positioned above the separating wall.

8. The ice making assembly of claim 1, wherein the control system is configured to fill the ice tray with water.

9. The ice making assembly of claim 8, wherein the control system includes an input, a controller, and a filling apparatus.

10. The ice making assembly of claim 1, wherein a separating wall is positioned adjacent the second cavity and separates the second cavity from an adjacent first cavity.

11. The ice making assembly of claim 1, further including a receptacle including a dividing wall separating the receptacle into a first portion and a second portion, wherein the first portion is configured to receive first ice cubes formed by the first cavities and the second portion is configured to receive second ice cubes formed by the second cavity.

12. The ice making assembly of claim 11, wherein the receptacle is positioned below the ice tray such that the first portion is aligned with the first section and the second portion is aligned with the second section.

13. The ice making assembly of claim 1, wherein the second cavity has a shape that is greater in length than the first cavities.

14. The ice making assembly of claim 1, wherein the control system uses a same hose, or a same tube to deliver liquid to both the first section and second section of the ice tray.

15. The ice making assembly of claim 14, wherein the same hose or the same tube puts liquid first in the plurality of the first cavities, and then the liquid flows from the plurality of first cavities to the second cavity.

* * * * *